US008106932B2

(12) United States Patent
Yoshimura

(10) Patent No.: US 8,106,932 B2
(45) Date of Patent: Jan. 31, 2012

(54) IMAGE FORMATION APPARATUS AND METHOD FOR FORMING IMAGE

(75) Inventor: Yoshihiro Yoshimura, Kanagawa (JP)

(73) Assignee: Sony Corporation (JP)

( * ) Notice: Subject to any disclaimer, the term of this patent is extended or adjusted under 35 U.S.C. 154(b) by 339 days.

(21) Appl. No.: 12/583,724

(22) Filed: Aug. 25, 2009

(65) Prior Publication Data

US 2010/0051185 A1 Mar. 4, 2010

(30) Foreign Application Priority Data

Sep. 2, 2008 (JP) ..... P2008-225142

(51) Int. Cl.
*B41J 2/00* (2006.01)

(52) U.S. Cl. ..... 347/193

(58) Field of Classification Search ..... 347/193, 347/171, 172, 174, 176, 188
See application file for complete search history.

(56) References Cited

U.S. PATENT DOCUMENTS 5,719,616 A * 2/1998 Danjo et al. ..... 347/193
6,211,894 B1 * 4/2001 Yamaya et al. ..... 347/193
2002/0089580 A1 * 7/2002 Suzuki et al. ..... 347/172
2006/0227204 A1 * 10/2006 Chamandy ..... 347/193
2007/0064084 A1 3/2007 Kikuchi et al.

FOREIGN PATENT DOCUMENTS

JP 2000-153674 A 6/2000
JP 2004-106260 A 4/2004
JP 2006-182012 A 7/2006
JP 2007-076332 A 3/2007

* cited by examiner

*Primary Examiner* — Kristal Feggins
(74) *Attorney, Agent, or Firm* — Lerner, David, Littenberg, Krumholz & Mentlik, LLP

(57) ABSTRACT

An image formation apparatus includes a transporting section configured to transport a thermal transfer sheet; a carrying section configured to carry a thermal transfer receiving sheet; a thermal head configured to sequentially thermally transfer the color material layer and the protective layer of the thermal transfer sheet onto the thermal transfer receiving sheet by applying thermal energy; and a controlling section configured to control the thermal energy, wherein the controlling section is configured to print an image under printing conditions where variation $\Delta H$ in a thickness of the thermal transfer receiving sheet in an increase direction before and after the thermal transfer of the color material layer satisfies $0<\Delta H$, and variation $\Delta L$ in the thickness of the thermal transfer receiving sheet in the increase direction before and after the thermal transfer of the protective layer satisfies $\Delta L<0$.

5 Claims, 9 Drawing Sheets

IMAGE FORMATION APPARATUS AND METHOD FOR FORMING IMAGE

CROSS-REFERENCE TO RELATED APPLICATION

The present application claims priority from Japanese Patent Application No. JP 2008-225142 filed in the Japanese Patent Office on Sep. 2, 2008, the entire content of which is incorporated herein by reference.

BACKGROUND OF THE INVENTION

1. Field of the Invention

The present invention relates to an image formation apparatus configured to be capable of providing a silk-textured image by forming desired irregularities on a surface of a thermal transfer receiving sheet, and a method for forming an image in which a silk-textured image can be provided by forming desired irregularities on a surface of a thermal transfer receiving sheet.

2. Description of the Related Art

A sublimation-type thermal ink-transfer recording technique is an image formation technique that is neither a silver-salt photographic process nor an electrophotographic process and provides images similar to silver-salt color photographic images in an instant with compact equipment that is easily maintained. The principle of this type of image formation is as follows: thermal energy that is controlled in accordance with image signals is provided to a thermal head, color materials on a thermal transfer sheet are phase-changed (becoming molten or sublimed) as a result of the thermal energy and transferred onto a recording sheet, thereby forming an image with gradation. Such a recording technique uses, as color materials, dyes that are extremely sharp and highly transparent. For this reason, use of such a recording technique can provide images that are excellent in terms of the reproducibility of halftones and gradation properties and have a quality equivalent to that of silver-salt photographic images.

With the recent trend toward widespread use of computers in individual households, various recording techniques such as a sublimation-type thermal ink-transfer recording technique and an inkjet recording technique have been markedly applied to home use. With the recent trend toward remarkable proliferation of digital cameras, there is an ever increasing demand for photographic printing that provides high image quality equivalent to that of silver-salt photographic images.

Among various features demanded for photographic printing, one feature is providing of silk-textured images. Silk-textured images provided by a silver-salt photographic process are formed so as to have micro irregularities on their surfaces, thereby causing scattering of light and reducing specular reflection. Silk-textured images maintain the micro gloss on their surfaces while having reduced image clarity, thereby providing a quality appearance. Formation of silk-textured images is an advantageous technique for adding a quality appearance to large photographic images, in particular, portrait-size images. Such formation of silk-textured images is also demanded in a sublimation-type thermal ink-transfer recording technique.

Japanese Unexamined Patent Application Publication No. 2006-182012 discloses a method for forming a printed matter by overlapping a thermal transfer image receiving sheet including a substrate and a receiving layer on the substrate and a thermal transfer sheet including a substrate and a dye layer containing a sublimation dye on the substrate, and heating the overlapped sheets. Specifically, a thermally transferred image is formed on the receiving layer with the sublimation dye and a protective layer is subsequently thermally transferred onto at least a portion of the thermally transferred image with a thermal transfer sheet including a substrate and the protective layer that can be thermally transferred on the substrate. Japanese Unexamined Patent Application Publication No. 2006-182012 also proposes a method for forming a printed matter, a surface of which is matted under a heating condition by stamping at least one portion of the protective layer with an embossed plate having irregularities on its surface. However, such a method for forming a printed matter according to Japanese Unexamined Patent Application Publication No. 2006-182012 is conducted with an extra large apparatus together with a printer, thereby adding extra costs. Such a method is also conducted with an extra step together with printing steps with a printer, thereby reducing productivity.

Japanese Unexamined Patent Application Publication No. 2000-153674 discloses a pigment-donor element for thermal pigment transfer, the element including, on a substrate, at least one pigment-layer region containing image pigment in a binder and a region constituting a protective layer that can be transferred. Specifically, the size of the region constituting a protective layer that can be transferred is substantially the same as the size of the pigment-layer region. The protective layer contains unexpanded synthetic thermoplastic polymer microspheres and the diameter of the microspheres in the unexpanded state is in the range of 5 to 20 μm. Japanese Unexamined Patent Application Publication No. 2000-153674 proposes that the microspheres are expanded to a diameter in the range of 20 to 120 μm upon heating in transferring the protective layer onto an image receiving layer for the purpose of adding a matte surface to the surface of the image receiving layer. However, use of the method disclosed in Japanese Unexamined Patent Application Publication No. 2000-153674 does not provide surface irregularities for forming silk-textured images and a silk texture equivalent to that of silver-salt photographic images is not provided. Additionally, since the protective layer contains microspheres, use of the method disclosed in Japanese Unexamined Patent Application Publication No. 2000-153674 provides matte surfaces and hence switching between formation of gloss images and formation of silk-textured images in accordance with demand is not conducted.

Japanese Unexamined Patent Application Publication No. 2004-106260 discloses a method for forming a protective layer in which a protective layer is thermally transferred onto an image on a receiver with a protective-layer transfer sheet, and the gloss of the surface of the protective layer can be changed by controlling the degree of heating upon the thermal transfer. In the protective-layer transfer sheet, the protective layer composed of a thermoplastic resin and an inorganic layer compound and an adhesion layer that can be thermally transferred are sequentially stacked on a substrate. However, use of the method disclosed in Japanese Unexamined Patent Application Publication No. 2004-106260 only provides variation in the gloss of the surface of the protective layer and does not provide irregularities on the surface for forming silk-textured images. Thus, a silk texture equivalent to that of silver-salt photographic images is not provided.

Japanese Unexamined Patent Application Publication No. 2007-076332 discloses that, when variation Dx in the thickness of a recording medium upon thermal transfer of the color material layer of a thermal transfer sheet onto the recording medium is defined by the following formula (1), and variation Dy in the thickness of the recording medium upon thermal transfer of the protective layer of a thermal transfer sheet onto the thermally transferred image on the recording medium is defined by the following formula (2), the carrying speed of the recording medium is controlled such that Dy≧Dx is satisfied.

$$Dx=|Lb-La|\ldots \quad (1)$$

$$Dy=|Lc-La|\ldots \quad (2)$$

La=thickness of recording medium before image formation

Lb=thickness of recording medium at position having minimum thickness after image formation Lc=thickness of recording medium in the case of applying, to thermal head, minimum thermal energy capable of thermally transferring protective layer onto recording medium Specifically, Japanese Unexamined Patent Application Publication No. 2007-076332 proposes that surface irregularities for providing silk-textured images are formed by increasing the carrying speed of the recording medium upon thermal transfer of the color material layer thereby to reduce the degree of collapse of the recording medium in the thickness direction upon the thermal transfer of the color material layer, and by decreasing the carrying speed of the recording medium upon thermal transfer of the protective layer thereby to increase the degree of collapse of the recording medium in the thickness direction upon the thermal transfer of the protective layer. However, in this case, since the recording medium is collapsed in the thickness direction upon the thermal transfer of the color material layer, there is a possibility that a sufficiently large collapse margin for forming irregularities having a large height difference for providing a silk texture equivalent to that of silver-salt photographic images is not provided upon the thermal transfer of the protective layer.

SUMMARY OF THE INVENTION

Accordingly, it is desirable to provide an image formation apparatus configured to be capable of providing a silk-textured image by forming desired irregularities on a surface of a thermal transfer receiving sheet, and a method for forming an image in which a silk-textured image can be provided by forming desired irregularities on a surface of a thermal transfer receiving sheet.

An image formation apparatus according to an embodiment of the present invention includes a transporting section configured to transport a thermal transfer sheet on which a color material layer and a protective layer are sequentially arranged in a transporting direction, a carrying section configured to carry a thermal transfer receiving sheet in which at least a color material receiving layer for receiving a color material is formed on a support, a thermal head configured to sequentially thermally transfer the color material layer and the protective layer of the thermal transfer sheet onto the thermal transfer receiving sheet by applying thermal energy to the color material layer and the protective layer of the thermal transfer sheet in a state that the color material layer and the protective layer are positioned to face the color material receiving layer of the thermal transfer receiving sheet, and a controlling section configured to control the thermal energy of the thermal head.

A method for forming an image according to an embodiment of the present invention includes the steps of transporting a thermal transfer sheet on which a color material layer and a protective layer are sequentially arranged in a transporting direction; carrying a thermal transfer receiving sheet in which at least a color material receiving layer for receiving a color material is formed on a support; forming an image by applying thermal energy with a thermal head to the color material layer of the thermal transfer sheet, in a state that the color material layer is positioned to face the color material receiving layer of the thermal transfer receiving sheet, to thermally transfer the color material layer of the thermal transfer sheet onto the color material receiving layer of the thermal transfer receiving sheet; and thermally transferring the protective layer of the thermal transfer sheet onto the image formed on the thermal transfer receiving sheet by applying thermal energy with the thermal head to the protective layer of the thermal transfer sheet in a state that the protective layer is positioned to face the image formed on the thermal transfer receiving sheet.

In such an image formation apparatus and such a method for forming an image according to embodiments of the present invention, the image is printed under printing conditions where variation ΔH represented by the following formula (1) in a thickness of the thermal transfer receiving sheet in an increase direction before and after the thermal transfer of the color material layer satisfies 0<ΔH, and variation ΔL represented by the following formula (2) in the thickness of the thermal transfer receiving sheet in the increase direction before and after the thermal transfer of the protective layer satisfies ΔL<0.

$$\Delta H=(\text{thickness of thermal transfer receiving sheet after thermal transfer of color material layer})-(\text{thickness of thermal transfer receiving sheet before thermal transfer of color material layer}) \quad (1)$$

$$\Delta L=(\text{thickness of thermal transfer receiving sheet after thermal transfer of protective layer})-(\text{thickness of thermal transfer receiving sheet before thermal transfer of protective layer}) \quad (2)$$

In an image formation apparatus according to another embodiment of the present invention, the controlling section is configured to thermally transfer the protective layer onto the thermal transfer receiving sheet in accordance with an irregularity pattern, the irregularity pattern upon the thermal transfer of the protective layer includes first, second, and third thermal energy regions respectively formed by different thermal energies e1, e2, and e3 applied upon the thermal transfer of the protective layer, and the thermal energies e1, e2, and e3 respectively applied to the first, second, and third thermal energy regions satisfy a relationship represented by the following formula (3) with respect to minimum thermal energy e0 capable of thermally transferring the protective layer onto the thermal transfer receiving sheet.

$$\text{First thermal energy } e1>\text{Second thermal energy } e2>e0>\text{Third thermal energy } e3 \quad (3)$$

In an image formation apparatus according to another embodiment of the present invention, the irregularity pattern upon the thermal transfer of the protective layer includes the third thermal energy region at a boundary between the first thermal energy region and the second thermal energy region.

In an image formation apparatus according to another embodiment of the present invention, the thermal transfer receiving sheet at least includes an intermediate layer between the color material receiving layer and the support, and the intermediate layer contains hollow particles.

According to an embodiment of the present invention, by printing an image under printing conditions where variation ΔH in the thickness of a thermal transfer receiving sheet in an increase direction before and after thermal transfer of a color material layer satisfies 0<ΔH and variation ΔL in the thickness of the thermal transfer receiving sheet in the increase direction before and after thermal transfer of a protective layer satisfies ΔL<0, desired irregularities are formed on a surface of a printed matter. As a result, a silk-textured image of high quality can be provided.

DESCRIPTION OF THE PREFERRED EMBODIMENTS

Hereinafter, a sublimation-type image formation apparatus according to an embodiment of the present invention is described with reference to drawings.

Figure 1:
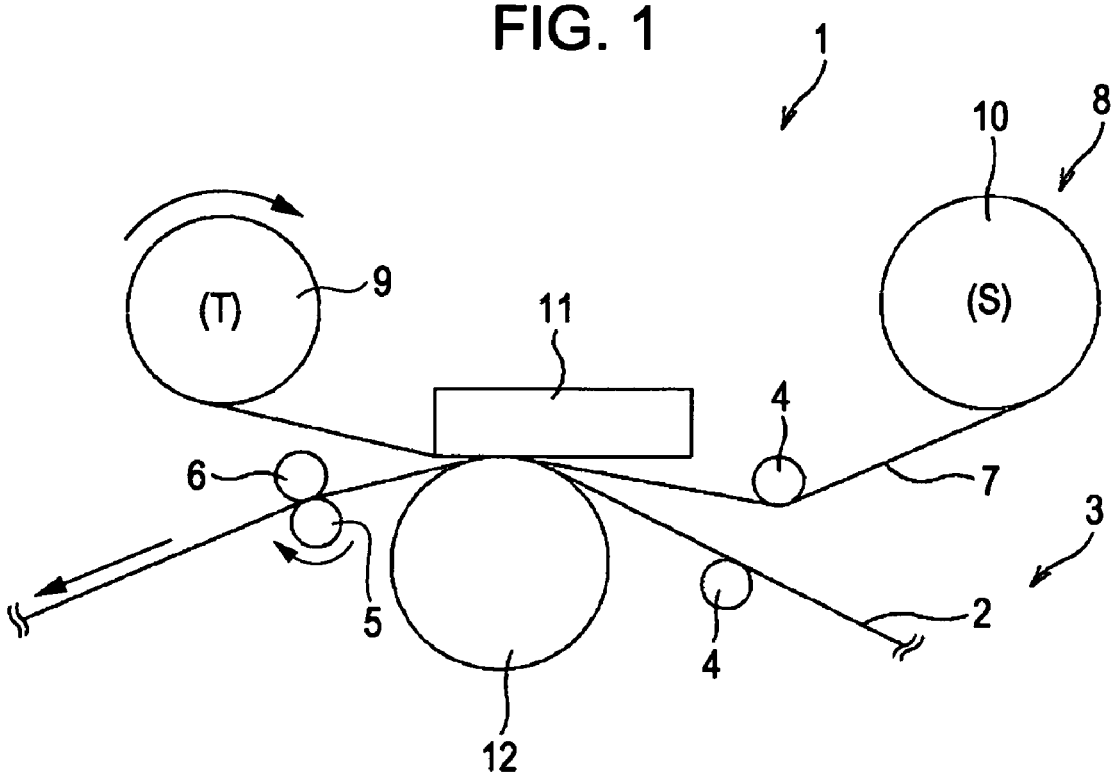
FIG. 1 shows the configuration of an image formation apparatus according to an embodiment of the present invention.

Referring to FIG. 1, an image formation apparatus 1 is configured, upon printing of an image, to carry a thermal transfer receiving sheet 2 serving as a recording medium 2 such as printing paper while a guide roller 4 constituting a carrier section 3 guides the thermal transfer receiving sheet and a capstan 5 and a pinch roller 6 hold the thermal transfer receiving sheet 2 therebetween. The image formation apparatus 1 is equipped with a cartridge containing a thermal transfer sheet 7. A take-up reel 9 constituting a transporting section 8 is rotated so that the thermal transfer sheet 7 is transported from a supply reel 10 to the take-up reel 9. A thermal head 11 and a platen roller 12 are arranged to face each other at an image printing position where the ink of the thermal transfer sheet 7 is thermally transferred to the thermal transfer receiving sheet 2. The dye of the thermal transfer sheet 7 is sublimed and thermally transferred to the thermal transfer receiving sheet 2 while the thermal transfer sheet 7 is pressed at a certain pressure toward the thermal transfer receiving sheet 2 by the thermal head 11.

Figure 2:
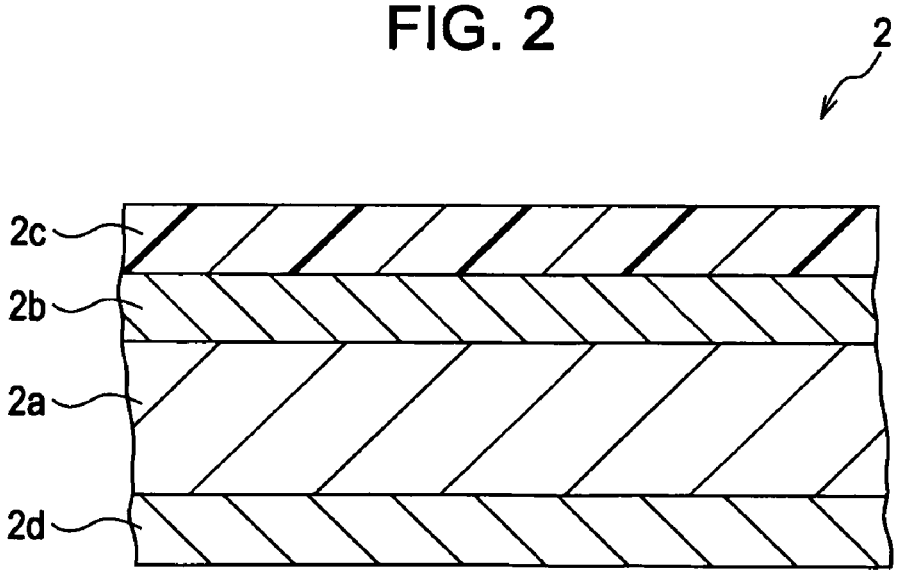
FIG. 2 is a section view of a major portion of a thermal transfer receiving sheet used for an image formation apparatus according to an embodiment of the present invention.

Referring to FIG. 2, the thermal transfer receiving sheet 2 will be described. The thermal transfer receiving sheet 2 includes a support 2*a*, an intermediate layer 2*b*, a color material receiving layer 2*c*, and a back-coated layer 2*d*. The intermediate layer 2*b* is provided on a surface of the support 2*a* and the color material receiving layer 2*c* is provided on the intermediate layer 2*b*. The back-coated layer 2*d* is formed on the other surface of the support 2*a*.

Examples of the support 2*a* include papers mainly composed of cellulose pulp, and synthetic resin films. Examples of papers mainly composed of cellulose pulp include wood free paper, wood containing paper, coated paper, and resin laminated paper. Synthetic resin films are composed of, for example, polyethylene, polypropylene, polyethylene terephthalate, polyamide, polyvinyl chloride, polystyrene, and polycarbonate. Note that the support 2*a* is not restricted to these examples and may be a multilayer film obtained by laminating such resin films. Alternatively, another film and the support 2*a* mainly composed of cellulose pulp may be laminated to form a multilayer film.

The intermediate layer 2*b* is formed by laminating layers containing hollow particles. An example of such a hollow particle is a microcapsule constituted by a core of low-boiling-point hydrocarbon and a shell of a thermoplastic resin such as vinylidene chloride or acrylonitrile. Examples of commercially available products of such hollow particles include DAIFORM (manufactured by Dainichiseika Color & Chemicals Mfg. Co., Ltd.), ADVANCELL (manufactured by SEKISUI CHEMICAL CO., LTD.), and Matsumoto Microsphere F-series (manufactured by Matsumoto Yushi-Seiyaku Co., Ltd.) Note that hollow particles contained in the intermediate layer 2*b* are not restricted to the examples described above. A hollow particle layer may be formed by coating a substance in an unfoamed state and subsequently foaming this coated substance in a drying step. Alternatively, a coating solution in which hollow particles are foamed in advance may be prepared and coated to form a hollow particle layer.

A binder resin used for a hollow particle layer is preferably a water-soluble polymer or a resin dispersed in water. Examples of such a binder resin include polyvinyl alcohol, carboxyl-modified polyvinyl alcohol, acetoacetyl-modified polyvinyl alcohol, acrylic-based emulsion, acrylate-based emulsion, styrene-acrylic-based emulsion, styrene-butadiene-based latex, and acrylonitrile-butadiene-based latex. A binder resin used for a hollow particle layer is not restricted to these examples and a water-soluble polymer or a resin dispersed in water will suffice.

Such a hollow particle layer is coated, for example, with a gravure coater, a roll coater, a die coater, a curtain coater, a blade coater, or a wire blade. The solid content of a hollow particle layer coated is preferably 1 to 100 g/m$^2$, and more preferably 5 to 50 g/m$^2$. When the solid content of a hollow particle layer coated is 1 g/m$^2$ or more, sufficiently high thermal insulation properties and cushioning properties can be provided. When the solid content of a hollow particle layer coated is 100 g/m$^2$ or less, a saturated state can be prevented.

The color material receiving layer 2*c* is provided on a surface of the intermediate layer 2*b*. The color material receiving layer 2*c* is configured to receive a dye to be thermally transferred from the thermal transfer sheet 7 and hold the received dye. The color material receiving layer 2*c* is formed of, for example, an acrylic resin, a polyester resin, a polyvinyl acetal resin, a polyvinyl butyral resin, a polyvinyl chloride resin, a polyvinyl acetate resin, a polyvinyl chloride-polyvinyl acetate copolymer resin, a cellulose acetate butyrate resin, a polycarbonate resin, a polystyrene resin, or a polyamide resin. Alternatively, the color material receiving layer 2*c* may be formed of a resin other than these examples as long as the resultant color material receiving layer 2*c* has a high compatibility with a dye to be thermally transferred from an ink ribbon, a high releasability of an ink ribbon after the thermal transfer, and a high compatibility with the resins of the laminate layers. The color material receiving layer 2*c* may be formed of such a resin further containing a crosslinking agent, a release agent, a filler, an anti-oxidizing agent, an ultraviolet absorbing agent, or the like.

The solid content of the color material receiving layer 2*c* coated is preferably 1 to 15 g/m$^2$, and more preferably 2 to 10 g/m$^2$. When the solid content of the color material receiving layer 2*c* coated is 1 g/m$^2$ or more, the film forming property of a coating material can be enhanced. Specifically, the color material receiving layer 2*c* can be formed so as to be flat without being influenced by irregularities in the support 2*a* and the intermediate layer 2*b*. When the solid content of the color material receiving layer 2*c* coated is 15 g/m$^2$ or less, degradation of a thermal insulation effect against thermal energy to be applied from the thermal head 11 can be suppressed and degradation of the density of an image to be printed can be suppressed. Additionally, the occurrence of various problems such as generation of cracking or curling of the color material receiving layer 2*c* can be suppressed.

The back-coated layer 2*d* is formed on the other surface of the support 2*a*. The back-coated layer 2*d* is intended to suppress scratching of the color material receiving layer 2*c* when the back-coated layer 2*d* is brought into contact with the color material receiving layer 2*c*. The back-coated layer 2*d* is also intended to suppress static electrification, suppress the curling of the thermal transfer receiving sheet 2, reduce friction between the thermal transfer receiving sheet 2 and the guide roller 4 and the platen roller 12, and the like. As a result, the capability of carrying the thermal transfer receiving sheet 2 of a printer upon printing is enhanced. The back-coated layer 2*d* is constituted by a resin and a filler. A preferred example of such a resin is an acrylic resin, an epoxy resin, a polyester resin, a phenol resin, a urethane resin, a melamine resin, a polyvinyl acetal resin, or a polyvinyl butyral resin. Preferred examples of such a filler include various organic fillers and inorganic fillers. A representative example of organic fillers is a nylon filler, a cellulose filler, a benzoguanamine filler, a styrene filler, an acrylic filler, or a silicone filler. A representative example of inorganic fillers is silica, talc, clay, kaoline, mica, smectite, barium sulfate, titanium dioxide, or calcium carbonate.

The thermal transfer receiving sheet 2 has the above-described configuration in which the intermediate layer 2*b* is constituted by a laminate of layers containing hollow particles. As a result, the hollow particles are slightly expanded by thermal energy applied upon thermal transfer of a color material layer and hence unintended formation of irregularities upon the thermal transfer of the color material layer can be suppressed. At this time, in the thermal transfer receiving sheet 2, the adhesion between the intermediate layer 2*b* and the color material receiving layer 2*c* can be enhanced and the cushioning properties of the thermal transfer receiving sheet 2 against a predetermined pressure applied by the thermal head 11 can also be enhanced.

By selectively changing thermal energy upon thermal transfer of a protective layer 7*f* with the thermal head 11 described below, variation is generated in thermal energy applied to the intermediate layer 2*b* of the thermal transfer receiving sheet 2. As a result, there is a variation in the manner in which the hollow particles of the intermediate layer 2b are collapsed and hence a desired irregularity pattern is formed. Thus, a surface of the thermal transfer receiving sheet 2 is arbitrarily surface-treated so as to have a silk texture. In this case, since the hollow particles of the thermal transfer receiving sheet 2 are expanded by thermal energy upon the thermal transfer of a color material layer, the collapse margin of the thermal transfer receiving sheet 2 upon the thermal transfer of the protective layer 7*f* can be made larger than that of an existing thermal transfer receiving sheet, which is collapsed in the thickness direction upon the thermal transfer of a color material layer. Thus, an irregularity pattern having a sufficiently large height difference can be formed with the thermal transfer receiving sheet 2.

Note that the configuration of the thermal transfer receiving sheet 2 according to an embodiment of the present invention is not restricted as long as the intermediate layer 2*b* and the color material receiving layer 2*c* are formed on the support 2*a*.

Figure 3:
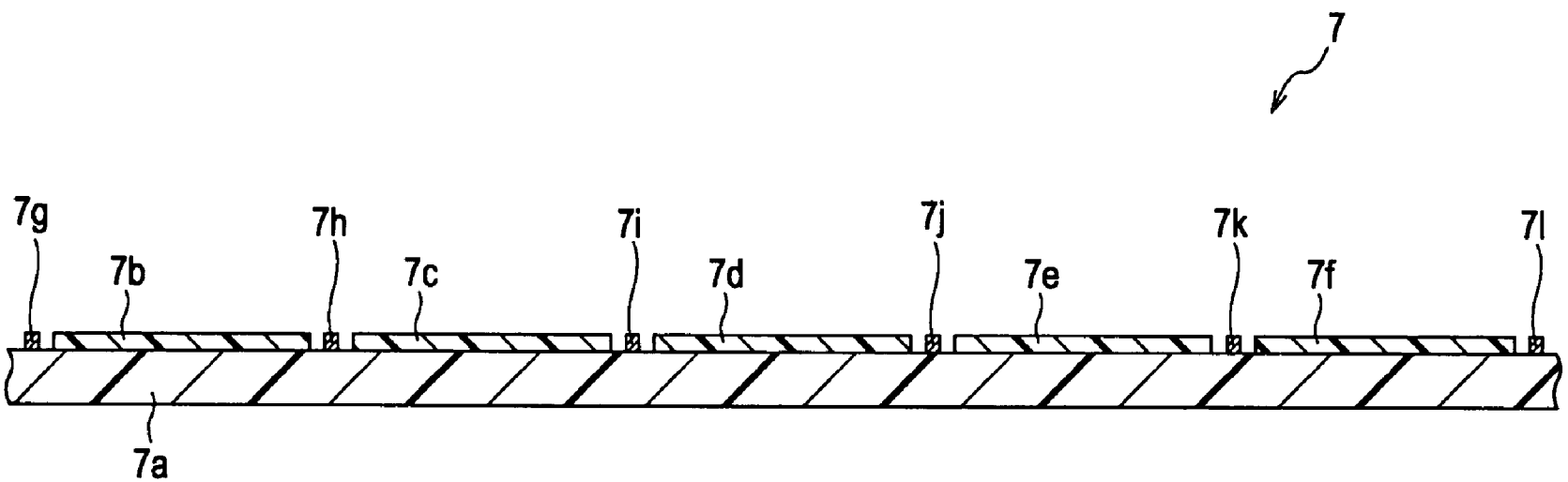
FIG. 3 is a section view of a thermal transfer sheet used for an image formation apparatus according to an embodiment of the present invention.

Referring to FIG. 3, the configuration of the thermal transfer sheet 7 will be described. Color material layers 7*b*, 7*c*, 7*d*, and 7*e* composed of respective dyes of yellow, magenta, cyan, and black for forming images and a thermoplastic resin and the protective layer 7*f* that is configured to protect the surfaces of the images and is composed of, for example, the same thermoplastic resin are arranged in the longitudinal direction on a surface of a support 7a composed of a synthetic resin film such as a polyester film or a polystyrene film. The color material layers 7*b*, 7*c*, 7*d*, and 7*e* and the protective layer 7*f* are arranged as a unit. Such units are sequentially arranged in the longitudinal direction of the support 7*a*. The color material layers 7*b*, 7*c*, 7*d*, and 7*e* and the protective layer 7*f* are sequentially thermally transferred to the color material receiving layer 2*c* of the thermal transfer receiving sheet 2 with the thermal head 11 by the application of thermal energy in accordance with image data to be printed.

Note that the configuration of the thermal transfer sheet 7 according to an embodiment of the present invention is not restricted as long as the thermal transfer sheet 7 at least includes the protective layer 7*f* and any one of the color material layers 7*b*, 7*c*, 7*d*, and 7*e*. For example, the thermal transfer sheet 7 may be constituted by the color material layer 7*e* (black) and the protective layer 7*f*. Alternatively, the thermal transfer sheet 7 may be constituted by the color material layers 7*b* (yellow), 7*c* (magenta), 7*e* (cyan) and the protective layer 7*f*.

Figure 4:
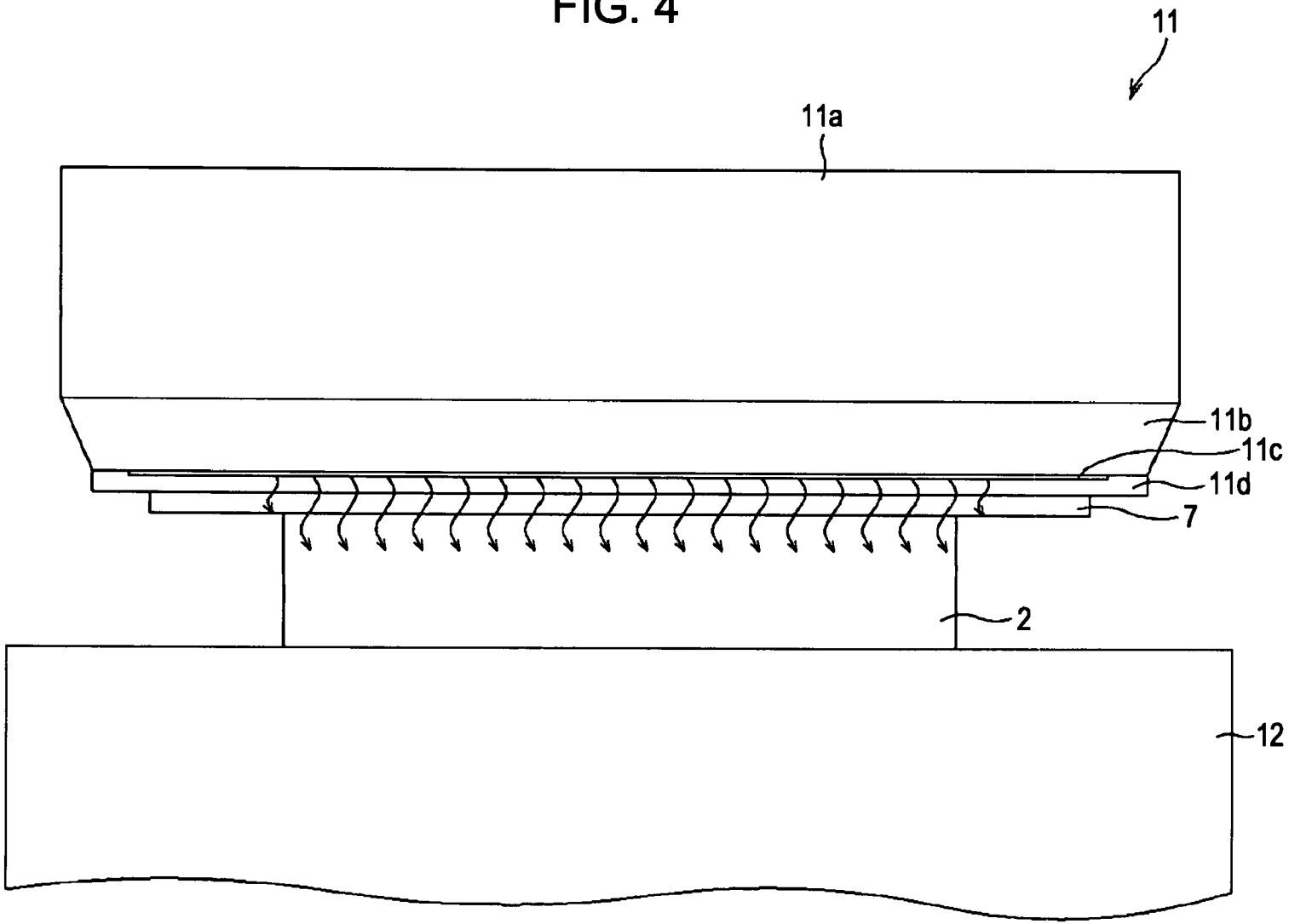
FIG. 4 is a front view of a thermal head of an image formation apparatus according to an embodiment of the present invention.

Referring to FIG. 4, the configuration of the thermal head 11 will be described. A heating device 11*c* constituted by a heat resistor or the like is provided in the shape of a line on a ceramic substrate 11*a* with a grace layer 11*b* therebetween. A protective layer 11*d* for protecting the heating device 11*c* is provided on the heating device 11*c*. The ceramic substrate 11*a* is excellent in a heat dissipation property and functions to suppress heat accumulation in the heating device 11*c*. The grace layer 11*b* is configured to protrude the heating device 11*c* toward the thermal transfer receiving sheet 2 and the thermal transfer sheet 7 so that the heating device 11*c* is brought into contact with the thermal transfer receiving sheet 2 and the thermal transfer sheet 7. The grace layer 11*b* also serves as a buffer layer that functions to suppress excessive transfer of the heat of the heating device 11*c* to the ceramic substrate 11*a*. The thermal head 11 is configured to thermally transfer the dye of the thermal transfer sheet 7 sandwiched by the thermal head 11 and the thermal transfer receiving sheet 2 to the thermal transfer receiving sheet 2 by line-by-line heating the dye with the heating device 11*c* and sublimating the dye.

A control system 20 for the image formation apparatus 1 having the above-described configuration will be described.

Figure 5:
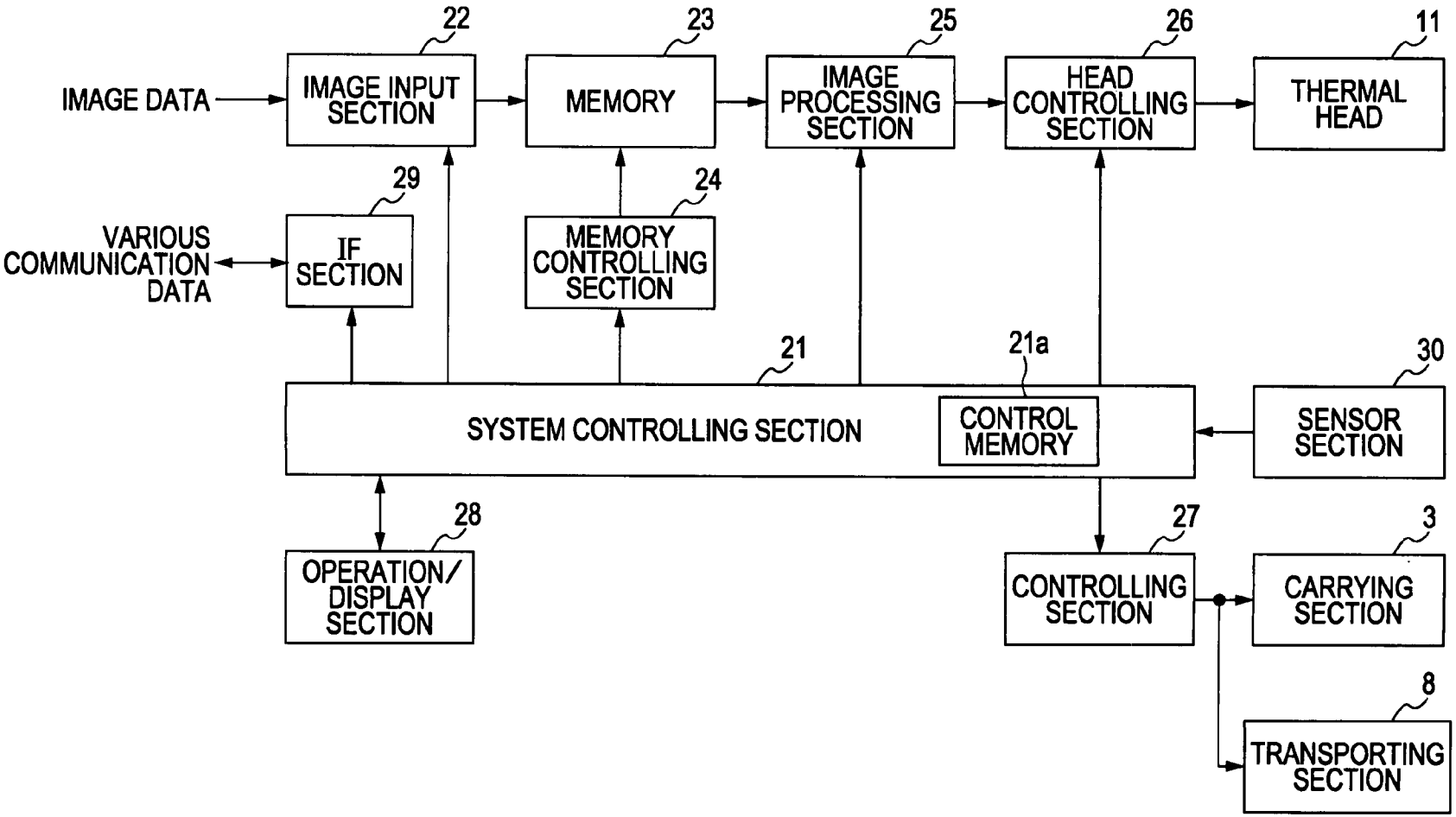
FIG. 5 is a block diagram of an image formation apparatus according to an embodiment of the present invention.

Referring to FIG. 5, the control system 20 includes a system controlling section 21 configured to control the whole operations of the image formation apparatus 1 on the basis of a control program that controls the whole operations and is contained in a control memory 21*a*. The control memory 21*a* contains an irregularity pattern for the protective layer 7*f*, the irregularity pattern serving as a thermal transfer pattern used upon thermal transfer of the protective layer 7f with the thermal head 11. This irregularity pattern for the protective layer 7*f* will be described below.

The control system 20 is connected to an electric device (not shown) such as recording and/or reproducing device equipped with a recording medium. The control system 20 includes an image input section 22 through which image data is input and a memory 23 configured to temporarily store image data input through the image input section 22.

The control system 20 further includes a memory controlling section 24 configured to read the irregularity pattern for the protective layer 7*f* from the control memory 21*a* and store the irregularity pattern in the memory 23.

The control system 20 further includes an image processing section 25 configured to subject image data stored in the memory 23 to image processing and generate image data for printing. For example, the image processing section 25 is configured to subject image data stored in the memory 23 to image processing such as color conversion, gamma adjustment, sharpness adjustment, or heat accumulation correction; image processing directed by an operation/display section 28 described below such as printing size conversion or image modification; or image processing in accordance with various printing conditions such as the characteristics or the driving type of the thermal head 11 or the characteristics of the thermal transfer receiving sheet 2 or the thermal transfer sheet 7. In this way, the image processing section 25 is configured to generate image data for printing.

In this case, while the image processing section 25 is configured to subject image data to image processing in accordance with the various printing conditions described above, the image processing section 25 is also configured to generate image data for printing such that the image data is to be printed under printing conditions where variation ΔH (μm) represented by the following formula (1) in the thickness of the thermal transfer receiving sheet 2 in the increase direction before and after the thermal transfer of the color material layers 7*b*, 7*c*, 7*d*, and 7*e* satisfies 0<ΔH, and variation ΔL (μm) represented by the following formula (2) in the thickness of the thermal transfer receiving sheet 2 in the increase direction before and after the thermal transfer of the protective layer 7*f* satisfies ΔL<0.

$$\Delta H = (\text{thickness of thermal transfer receiving sheet after thermal transfer of color material layers}) - (\text{thickness of thermal transfer receiving sheet before thermal transfer of color material layers}) \quad (1)$$

$$\Delta L = (\text{thickness of thermal transfer receiving sheet after thermal transfer of protective layer}) - (\text{thickness of thermal transfer receiving sheet before thermal transfer of protective layer}) \quad (2)$$

The control system 20 further includes a head controlling section 26 configured to generate driving signals for driving the heating device 11*c* constituting the thermal head 11, in accordance with image data for printing fed by the image processing section 25 and the irregularity pattern for the protective layer 7*f*. The head controlling section 26 is configured to feed driving signals generated in accordance with the image data for printing and the irregularity pattern for the protective layer 7*f* to the thermal head 11, thereby to drive the heating devices 11*c* of the thermal head 11.

The control system 20 further includes a controlling section 27 configured to control a carrying section 3 and a transporting section 8 in accordance with image data for printing fed by the image processing section 25. The carrying section 3 is configured to carry the thermal transfer receiving sheet 2 on a predetermined carrying route. The transporting section 8 is configured to transport the thermal transfer sheet 7 on a predetermined transporting route.

The control system 20 further includes the operation/display section 28 connected to a display device (not shown) for displaying images to be printed, such as an LCD (liquid crystal display) or a CRT (cathode ray tube). The operation/display section 28 receives direction data such as printing size conversion or image modification for an image to be printed, the direction data being generated by user operation with a display device.

The control system 20 further includes an IF section 29 connected to an external computer or an external network (not shown). The IF section 29 is configured to provide image data or an irregularity pattern for the protective layer 7*f* from an external computer via a network, to provide operation signals for the control system 20 from a remote controlling system at a remote site, or to send the operation status data of the control system 20 to an external computer at a remote site via a network.

The control system 20 further includes a sensor section 30 configured to detect the positions of the color material layer 7*b* (yellow), the color material layer 7*c* (magenta), the color material layer 7*d* (cyan), the color material layer 7*e* (black), and the protective layer 7*f*, and the initial printing position of the thermal transfer receiving sheet 2. Specifically, the sensor section 30 is configured to detect, upon printing of an image on the thermal transfer receiving sheet 2, marks that are provided on the thermal transfer receiving sheet 2 and show the initial printing end and the terminal printing end of the printing region of the thermal transfer receiving sheet 2; referring to FIG. 3, marks 7*g*, 7*h*, 7*i*, 7*j*, and 7*k* that are provided upstream in the transport direction of the color material layers 7*b*, 7*c*, 7*d*, and 7*e* and the protective layer 7*f* of the thermal transfer sheet 7 and show the initial ends and the terminal ends of the color material layers 7*b*, 7*c*, 7*d*, and 7*e* and the initial end of the protective layer 7*f*; and, referring to FIG. 3, a mark 71 that is provided downstream in the transport direction of the protective layer 7*f* and shows the terminal end of a unit of the color material layers 7*b*, 7*c*, 7*d*, and 7*e* and the protective layer 7*f*.

Hereinafter, the printing operations of the image formation apparatus 1 having the above-described configuration are described.

The system controlling section 21 temporarily stores, in the memory 23, image data received from the image input section 22 or the IF section 29. The system controlling section 21 subsequently reads an irregularity pattern for the protective layer 7*f* from the control memory 21*a* and stores the irregularity pattern in the memory 23 via the memory controlling section 24.

The system controlling section 21 subsequently subjects the image data stored in the memory 23 to image processing such as color conversion, gamma adjustment, sharpness adjustment, or heat accumulation correction with the image processing section 25. The system controlling section 21 generates image data for printing from the resultant image data with the image processing section 25 such that the image data is to be printed under a printing condition in which variation ΔH represented by the formula (1) above in the thickness of the thermal transfer receiving sheet 2 in the increase direction before and after the thermal transfer of the color material layers 7*b*, 7*c*, 7*d*, and 7*e* satisfies 0<ΔH. Note that use of existing techniques, for example, disclosed in Japanese Unexamined Patent Application Publication No. 2007-076332, results in 0>ΔH after the thermal transfer of the color material layers 7*b*, 7*c*, 7*d*, and 7*e*. In contrast, according to an embodiment of the present invention, 0<ΔH is achieved with a configuration where the thermal transfer receiving sheet 2 includes the intermediate layer 2*b* containing hollow particles that are expanded by thermal energy upon the thermal transfer of the color material layers 7*b*, 7*c*, 7*d*, and 7*e*.

The system controlling section 21 subsequently generates, with the head controlling section 26, driving signals for driving the heating device 11*c* constituting the thermal head 11, in accordance with image data for printing fed by the image processing section 25 and the irregularity pattern for the protective layer 7*f*.

The system controlling section 21 subsequently drives and controls, via the controlling section 27, the carrying section 3 in accordance with the driving signals to carry the thermal transfer receiving sheet 2 so that the initial printing position of the thermal transfer receiving sheet 2 detected by the sensor section 30 reaches the location of the thermal head 11.

The system controlling section 21 also drives and controls, via the controlling section 27, the transporting section 8 in accordance with the driving signals to transport the thermal transfer sheet 7 so that the color material layer 7*b* (yellow), the color material layer 7*c* (magenta), the color material layer 7*d* (cyan), the color material layer 7*e* (black), and the protective layer 7*f* are sequentially thermally transferred onto the thermal transfer receiving sheet 2 being carried.

The system controlling section 21 also drives, via the head controlling section 26, the thermal head 11 in accordance with the driving signals generated in accordance with the image data for printing, thereby to sequentially thermally transfer the color material layers 7*b* (yellow), 7*c* (magenta), 7*d* (cyan), and 7*e* (black) of the thermal transfer sheet 7 such that the resultant image has a density in accordance with the image data for printing while variation ΔH in the thickness of the thermal transfer receiving sheet 2 in the increase direction before and after the thermal transfer of the color material layers 7*b*, 7*c*, 7*d*, and 7*e* satisfies 0<ΔH. Thus, an image is formed on the thermal transfer receiving sheet 2.

While transporting the thermal transfer receiving sheet 2, the system controlling section 21 drives, via the head controlling section 26, the thermal head 11 in accordance with the driving signals generated in accordance with the irregularity pattern for the protective layer 7*f*, thereby to thermally transfer the protective layer 7*f* onto the formed image in accordance with the irregularity pattern for the protective layer 7*f* so that variation ΔL in the thickness of the thermal transfer receiving sheet 2 in the increase direction before and after the thermal transfer of the protective layer 7*f* satisfies ΔL<0.

Hereinafter, the irregularity pattern for the protective layer 7*f* is described. Referring to FIG. 8(A), the irregularity pattern for the protective layer 7*f* upon the thermal transfer of the protective layer 7*f* includes three different thermal energy regions E1, E2, and E3 that are respectively formed with different thermal energies applied upon the thermal transfer of the protective layer 7f. In FIG. 8(A), thermal energy upon the thermal transfer of the protective layer 7*f* increases as the intensity of input signals increases. Thermal energies e1, e2, and e3 respectively applied to the three different thermal energy regions E1, E2, and E3 satisfy the relationship represented by the following formula (3) with respect to minimum thermal energy e0 capable of thermally transferring the protective layer 7*f* onto the thermal transfer receiving sheet 2.

$$\text{First thermal energy } e1 > \text{Second thermal energy } e2 > e0 > \text{Third thermal energy } e3 \quad (3)$$

Because of the difference between the thermal energies e1 and e2 respectively applied to the first thermal energy region E1 and the second thermal energy region E2 upon the thermal transfer of the protective layer 7*f*, different thermal energies are applied to the intermediate layer 2*b* of the thermal transfer receiving sheet 2. As a result, irregularities are formed due to variation in the degree of collapse of the surface of the protective layer 7*f* and the hollow particles of the intermediate layer 2*b*. Specifically, the protruded portions of the irregularity pattern of the protective layer 7*f* are formed by the first thermal energy region E1. The recessed portions of the irregularity pattern of the protective layer 7*f* are formed by the second thermal energy region E2. As a result, an image having a silk texture is formed on the thermal transfer receiving sheet 2.

In this case, the thermal transfer receiving sheet 2 further includes a third thermal energy region E3 to which third thermal energy e3 is applied at the boundary between the first thermal energy region E1 and the second thermal energy region E2. The third thermal energy e3 is smaller than the minimum thermal energy e0 capable of thermally transferring the protective layer 7*f* onto the thermal transfer receiving sheet 2. As a result, irregularities having a larger height difference are formed on the thermal transfer receiving sheet 2. Therefore, a silk-textured image having an enhanced image quality can be formed on the thermal transfer receiving sheet 2.

In this case, the third thermal energy e3 alone is too small to be capable of the thermal transfer of the protective layer 7*f* onto the thermal transfer receiving sheet 2. However, when the third thermal energy region E3 is formed together with the first thermal energy region E1 and the second thermal energy region E2 and the first thermal energy el and the second thermal energy e2 applied to neighboring pixels are conducted, the protective layer 7*f* can be thermally transferred onto the thermal transfer receiving sheet 2. Thus, the ratio of the third thermal energy region E3 to the first thermal energy region E1 and the second thermal energy region E2 preferably satisfies a range so that the protective layer 7*f* can be thermally transferred without problems.

The irregularity pattern for the protective layer 7*f* is not necessarily stored in the control memory 21*a* and may be stored in the memory 23.

Figure 9:
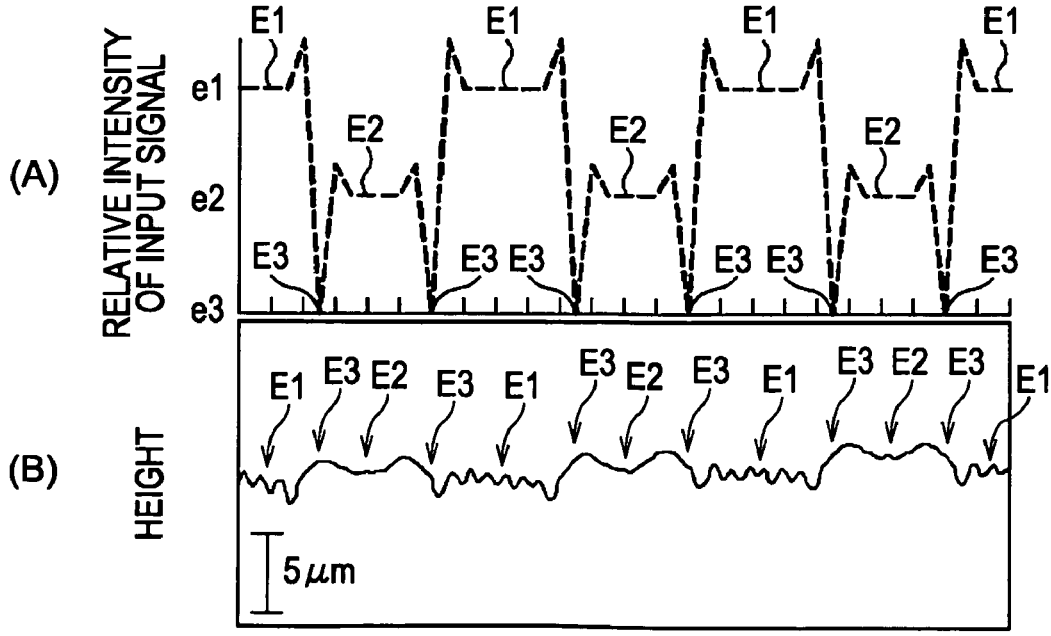
FIG. 9(A) shows an input signal profile in the width direction of a thermal transfer receiving sheet upon the thermal transfer of a protective layer in Example 2.
FIG. 9(B) shows a section view of the thermal transfer receiving sheet after the thermal transfer of the protective layer, the section view being shown so as to correspond to the profile.
Figure 10:
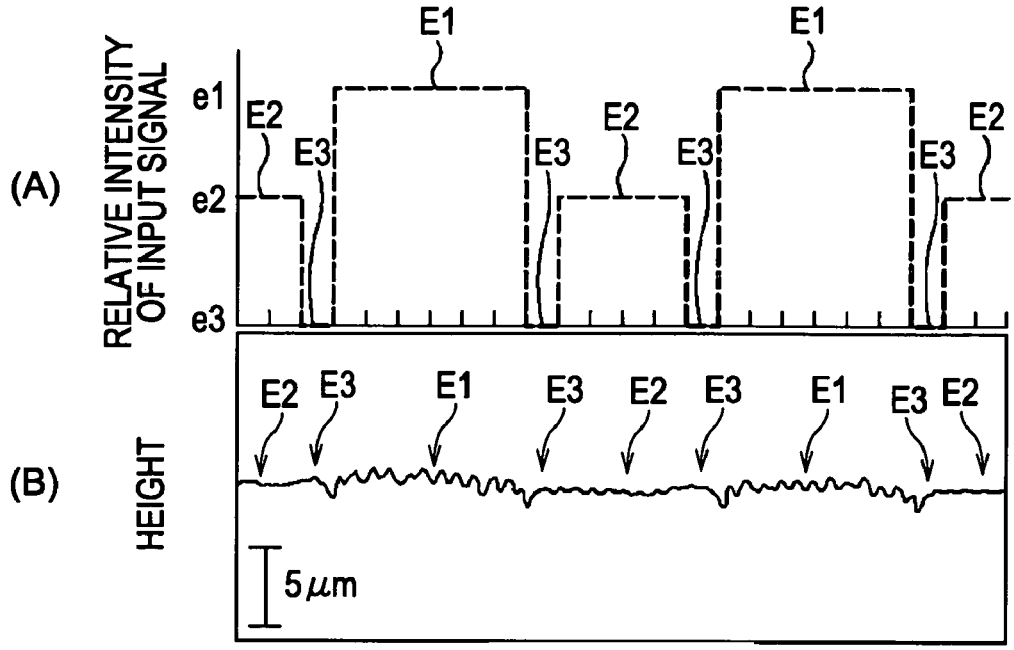
FIG. 10(A) shows an input signal profile in the width direction of a thermal transfer receiving sheet upon the thermal transfer of a protective layer in Comparative example 1.
FIG. 10(B) shows a section view of the thermal transfer receiving sheet after the thermal transfer of the protective layer, the section view being shown so as to correspond to the profile.
Figure 11:
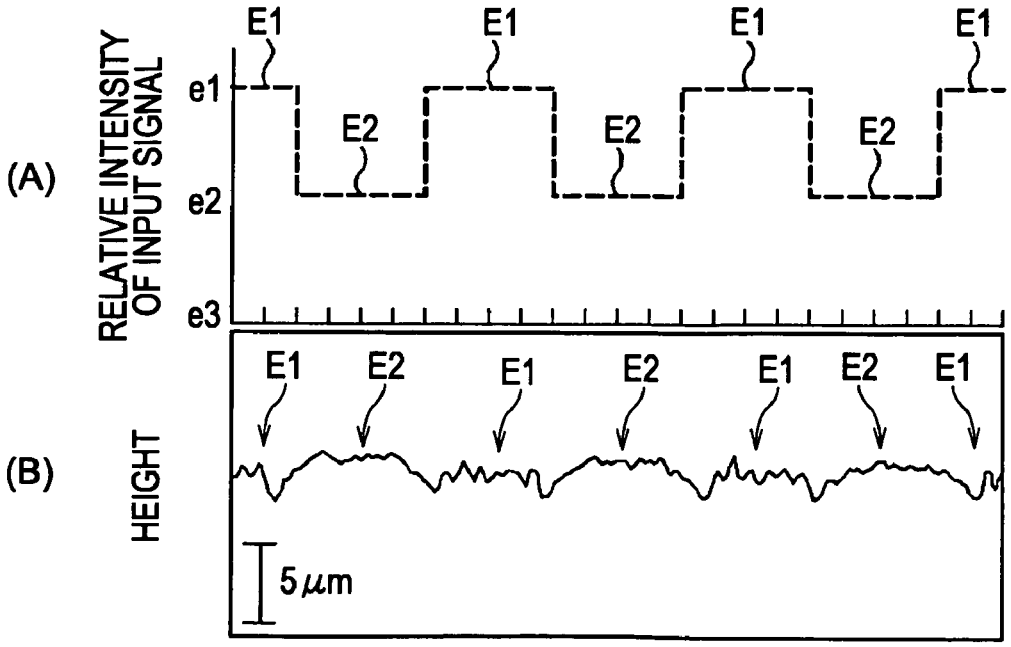
FIG. 11(A) shows an input signal profile in the width direction of a thermal transfer receiving sheet upon the thermal transfer of a protective layer in Comparative example 2.
FIG. 11(B) shows a section view of the thermal transfer receiving sheet after the thermal transfer of the protective layer, the section view being shown so as to correspond to the profile.
Figure 12:
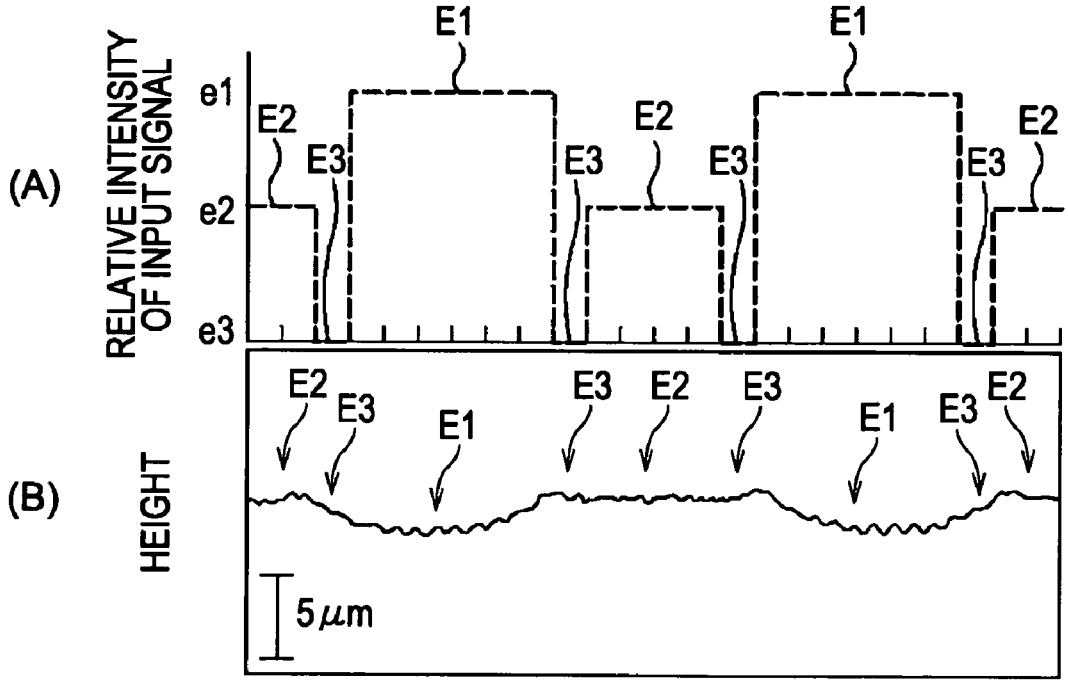
FIG. 12(A) shows an input signal profile in the width direction of a thermal transfer receiving sheet upon the thermal transfer of a protective layer in Comparative example 3.
FIG. 12(B) shows a section view of the thermal transfer receiving sheet after the thermal transfer of the protective layer, the section view being shown so as to correspond to the profile.

Alternatively, the irregularity pattern for the protective layer 7*f* may include three different thermal energy regions E1, E2, and E3 in which sharpness control is conducted at the boundary between the first thermal energy region E1 and the second thermal energy region E2 with the image processing section 25 to enhance the sharpness on the basis of an irregularity pattern that is fed from the image input section 22 or the IF section 29 and includes the first thermal energy region E1 and the second thermal energy region E2, or the irregularity pattern for the protective layer 7*f* including the first and the second thermal energy regions E1 and E2 and having been stored in the control memory 21*a* or the memory 23; and, referring to FIG. 9(A), the third thermal energy region E3 is formed by the thermal transfer of the protective layer 7*f* with the third thermal energy e3 that is smaller than the minimum thermal energy e0 capable of thermally transferring the protective layer 7*f* onto the thermal transfer receiving sheet 2. Alternatively, the irregularity pattern for the protective layer 7*f* whose sharpness is enhanced as described above may be stored in advance in the control memory 21*a* or the memory 23.

EXAMPLES

Hereinafter, embodiments of the present invention are described in detail with reference to Examples and Comparative examples.

Thermal Transfer Receiving Sheet A

An art paper sheet having a thickness of 150 μm was used as the support 2*a*. The intermediate layer 2*b* was formed by coating an intermediate layer coating solution having a composition shown in Table 1 below on a surface of the support 2*a* such that the solid content of the solution coated was 40 g/m$^2$ and drying the coated solution.

TABLE 1

| INTERMEDIATE LAYER COATING SOLUTION | |
|---|---|
| Component | Parts |
| Thermal expansion microcapsules (Trade name: Matsumoto Microsphere F30 manufactured by Matsumoto Yushi-Seiyaku Co., Ltd.) | 50 |
| Polyvinyl alcohol (Trade name: GOHSENOL GH-17 manufactured by The Nippon Synthetic Chemical Industry Co., Ltd.) | 5 |
| Acrylonitrile-butadiene latex (Trade name: Nipol 1561 manufactured by ZEON CORPORATION) | 30 |
| Water | 200 |

The thus-obtained support 2*a* including the intermediate layer 2*b* was coated with a color material receiving layer coating solution having a composition shown in Table 2 below such that the solid content of the solution coated was 5 g/m$^2$. The coated solution was dried and then cured at 50° C. for 48 hours to form the color material receiving layer 2*c*. Thus, a thermal transfer receiving sheet A was produced.

TABLE 2

| COLOR MATERIAL RECEIVING LAYER COATING SOLUTION | |
|---|---|
| Component | Parts |
| Polyester resin (Trade name: VYLON 220 manufactured by TOYOBO CO., LTD.) | 100 |
| Silicone oil (Trade name: KF-8010 manufactured by Shin-Etsu Chemical Co., Ltd.) | 2 |
| Crosslinking agent (Trade name: Takenate D-140N manufactured by Takeda Pharmaceutical Company Limited) | 10 |
| Methyl ethyl ketone | 100 |
| Toluene | 100 |

Thermal Transfer Receiving Sheet B

Instead of the intermediate layer 2*b* of the thermal transfer receiving sheet A, a polyolefin-based thermoplastic resin having a porous structure (TOYOPEARL-SS P4256 manufactured by TOYOBO CO., LTD.) was used. A film of this resin was laminated with a support by a dry laminating method with a polyurethane-based adhesive. The support 2*a* and the color material receiving layer 2*c* were formed with the same composition and in the same manner as in the thermal transfer receiving sheet A. Thus, a thermal transfer receiving sheet B was produced.

Evaluation 1

Printing was conducted with the thermal transfer receiving sheets A and B under the following conditions. The thicknesses of the thermal transfer receiving sheets A and B were measured before and after the printing and variation in the thicknesses before and after the printing was calculated.

Printing Conditions

Printer: digital photoprinter (UP-DR150 manufactured by Sony Corporation, resolution: 334 dpi)

Thermal transfer sheet: 2UPC-R155 (including yellow, magenta, and cyan dye ink layers and a protective layer)

Printed images: black gradation (1, 2, 3, 4, 5, 6) images composed of yellow, magenta, and cyan (thermal energy applied increased from the 1st gradation to the 6th gradation)

Printing speed: 0.7 msec/line, 2.0 msec/line, 4.0 msec/line

Thermal transfer energy for protective layer: The width of strobe pulse in the slow carrying speeds (2.0 msec/line and 4.0 msec/line) was adjusted so that the same recording density characteristic was provided in each gradation as in the high carrying speed (0.7 msec/line).

Figure 6:
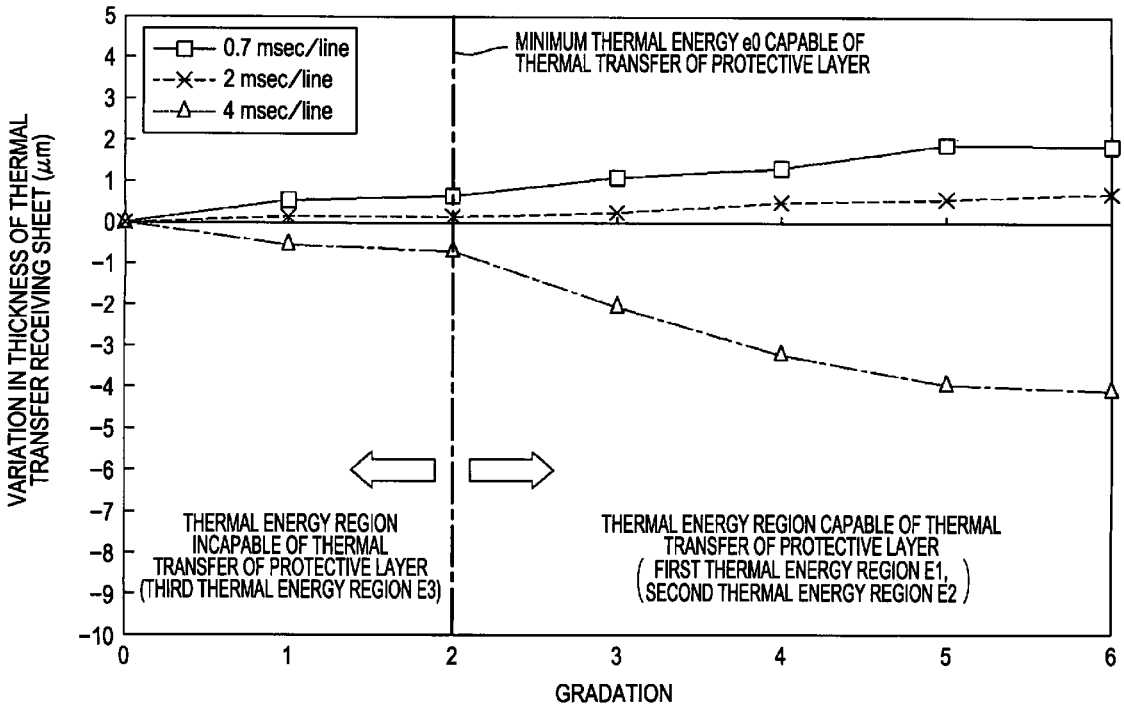
FIG. 6 is a graph where gradation upon printing is plotted along the abscissa axis and variation in the thickness of a thermal transfer receiving sheet A is plotted along the ordinate axis.
Figure 7:
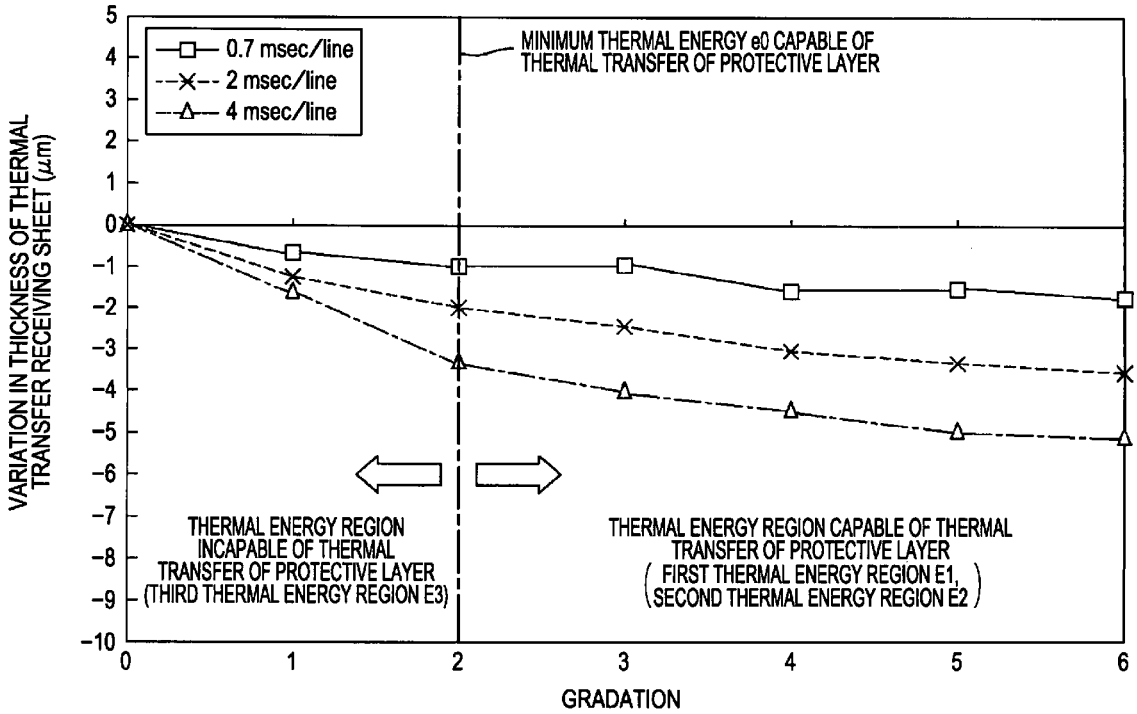
FIG. 7 is a graph where gradation upon printing is plotted along the abscissa axis and variation in the thickness of a thermal transfer receiving sheet B is plotted along the ordinate axis.

Variations in the thickness of the thermal transfer receiving sheet A in the carrying speeds 0.7, 2.0, and 4.0 msec/line upon printing are shown in FIG. 6. Variations in the thickness of the thermal transfer receiving sheet B in the carrying speeds 0.7, 2.0, and 4.0 msec/line upon printing are shown in FIG. 7. Zero in the abscissa axes in FIGS. 6 and 7 denotes the state of zero energy where no printing process was conducted.

Herein, the third thermal energy e3 according to an embodiment of the present invention is described. The second gradation in FIGS. 6 and 7 corresponds to the minimum thermal energy e0 capable of thermally transferring the protective layer. With the gradation (second gradation) serving as a boundary where the thermal transfer of the protective layer changes between incapable and capable, the lower gradation region was defined as an energy region where the thermal transfer of the protective layer was incapable, and the higher gradation region was defined as an energy region where the thermal transfer of the protective layer was capable. As shown in FIGS. 6 and 7, the third thermal energy e3 according to an embodiment of the present invention is defined as an energy region on the lower gradation side with the second gradation serving as the boundary. An energy profile of thermal application used for the thermal transfer of the protective layer was an energy profile for yellow used upon image formation.

Evaluation 2

Mat images were formed under the printing conditions below on the thermal transfer receiving sheets A and B and the resultant printed matters were evaluated by visual inspection. The evaluation results are shown in Table 3 below. Evaluation criteria were as follows.

Excellent: a silk texture equivalent to that in silver-salt photographic images is reproduced and the quality of the silk texture is excellent.

Good: a silk texture equivalent to that in silver-salt photographic images is reproduced and the quality of the silk texture is good.

Fair: a silk texture inferior to that in silver-salt photographic images is formed and the silk texture is defective.

Poor: a silk texture totally different from that in silver-salt photographic images is formed, the silk texture has an excessive mat appearance, and the silk texture is defective.

Printing Conditions

Printer: digital photoprinter (UP-DR150 manufactured by Sony Corporation, resolution: 334 dpi)

Thermal transfer sheet: 2UPC-R155 (including yellow, magenta, and cyan dye ink layers and a protective layer)

Printed images: black solid images composed of yellow, magenta, and cyan

Printing speed: 0.7 msec/line, 2.0 msec/line, 4.0 msec/line

Thermal transfer energy for protective layer: The width of strobe pulse in the slow carrying speeds (2.0 msec/line and 4.0 msec/line) was adjusted so that the same recording density characteristic was provided in each gradation as in the high carrying speed (0.7 msec/line).

Example 1

A black solid image was thermally transferred onto the thermal transfer receiving sheet A at 0.7 msec/line and a protective layer was subsequently transferred onto the black solid image at 4.0 msec/line. Referring to FIG. 8(A), an irregularity pattern for the protective layer upon the thermal transfer of the protective layer was used. The irregularity pattern included three different thermal energy regions E1, E2, and E3, and thermal energies e1, e2, and e3 respectively corresponding to these regions satisfied the relationship represented by the following formula (3) with respect to minimum thermal energy e0 capable of thermally transferring the protective layer onto the thermal transfer receiving sheet.

$$\text{First thermal energy } e1 > \text{Second thermal energy } e2 > e0 > \text{Third thermal energy } e3 \quad (3)$$

Figure 8:
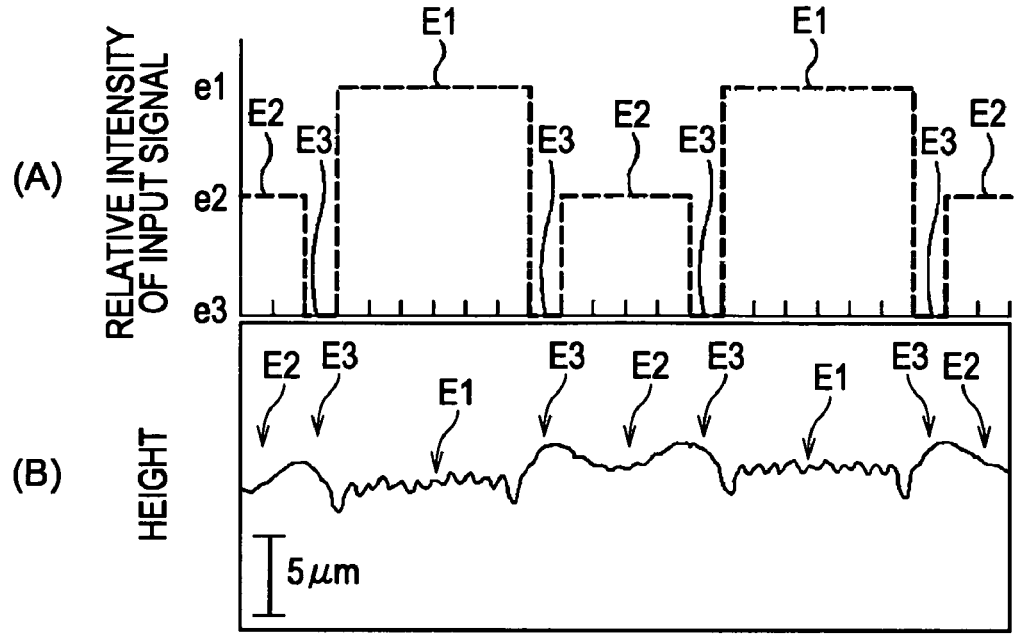
FIG. 8(A) shows an input signal profile in the width direction of a thermal transfer receiving sheet upon the thermal transfer of a protective layer in Example 1.
FIG. 8(B) shows a section view of the thermal transfer receiving sheet after the thermal transfer of the protective layer, the section view being shown so as to correspond to the profile.

FIG. 8(A) shows an input signal profile in the width direction of the thermal transfer receiving sheet upon the thermal transfer of the protective layer. FIG. 8(B) shows a section view of the thermal transfer receiving sheet after the thermal transfer of the protective layer, the section view being shown so as to correspond to input signals shown in FIG. 8(A). The scale in the abscissa axis in FIG. 8 (A) corresponds to the width (76 μm) of a pixel. The ordinate axis in FIG. 8(A) indicates the relative intensity of input signals. The thermal energy upon the thermal transfer of the protective layer increase as the intensity of input signals increases. The ordinate axis in FIG. 8(B) indicates the height of the irregularities of the thermal transfer receiving sheet after the thermal transfer of the protective layer. This height data was obtained with a 3D surface roughness measuring instrument (SE3400K manufactured by Kosaka Laboratory Ltd.) These descriptions are also applied to the ordinate axes and the abscissa axes in FIGS. 9 to 12.

Example 2

A black solid image was thermally transferred onto the thermal transfer receiving sheet A at 0.7 msec/line and a protective layer was subsequently thermally transferred onto the black solid image at 4.0 msec/line. Referring to FIG. 9(A), an irregularity pattern for the protective layer upon the thermal transfer of the protective layer was used. The irregularity pattern included the first thermal energy region E1 and the second thermal energy region E2, and sharpness control was conducted at the boundary between these different first and second thermal energy regions E1 and E2. As a result, the third thermal energy region E3 was formed where the thermal transfer of the protective layer was conducted with the third thermal energy e3 that was smaller than the minimum thermal energy e0 capable of thermally transferring the protective layer onto the thermal transfer receiving sheet in the irregularity pattern for the protective layer upon the thermal transfer of the protective layer. FIG. 9(A) shows an input signal profile in the width direction of the thermal transfer receiving sheet upon the thermal transfer of the protective layer. FIG. 9(B) shows a section view of the thermal transfer receiving sheet after the thermal transfer of the protective layer, the section view being shown so as to correspond to input signals shown in FIG. 9(A).

Comparative Example 1

A black solid image was thermally transferred onto the thermal transfer receiving sheet A at 0.7 msec/line and a protective layer was subsequently thermally transferred onto the black solid image at 2.0 msec/line. Referring to FIG. 10(A), an irregularity pattern for the protective layer upon the thermal transfer of the protective layer was used. The irregularity pattern included three different thermal energy regions E1, E2, and E3, and thermal energies e1, e2, and e3 respectively corresponding to these regions satisfied the relationship represented by the formula (3) above with respect to minimum thermal energy e0 capable of thermally transferring the protective layer onto the thermal transfer receiving sheet. FIG. 10(A) shows an input signal profile in the width direction of the thermal transfer receiving sheet upon the thermal transfer of the protective layer. FIG. 10(B) shows a section view of the thermal transfer receiving sheet after the thermal transfer of the protective layer, the section view being shown so as to correspond to input signals shown in FIG. 10(A).

Comparative Example 2

A black solid image was thermally transferred onto the thermal transfer receiving sheet A at 0.7 msec/line and a protective layer was subsequently thermally transferred onto the black solid image at 4.0 msec/line. Referring to FIG. 11(A), an irregularity pattern for the protective layer upon the thermal transfer of the protective layer was used. The irregularity pattern included two different thermal energy regions E1 and E2 (the first thermal energy region E1 and the second thermal energy region E2). FIG. 11(A) shows an input signal profile in the width direction of the thermal transfer receiving sheet upon the thermal transfer of the protective layer. FIG. 11(B) shows a section view of the thermal transfer receiving sheet after the thermal transfer of the protective layer, the section view being shown so as to correspond to input signals shown in FIG. 11(A).

Comparative Example 3

A black solid image was thermally transferred onto the thermal transfer receiving sheet B at 0.7 msec/line and a protective layer was subsequently thermally transferred onto the black solid image at 4.0 msec/line. Referring to FIG. 12(A), an irregularity pattern for the protective layer upon the thermal transfer of the protective layer was used. The irregularity pattern included three different thermal energy regions E1, E2, and E3, and thermal energies e1, e2, and e3 respectively corresponding to these regions satisfied the relationship represented by the formula (3) above with respect to minimum thermal energy e0 capable of thermally transferring the protective layer onto the thermal transfer receiving sheet. FIG. 12(A) shows an input signal profile in the width direction of the thermal transfer receiving sheet upon the thermal transfer of the protective layer. FIG. 12(B) shows a section view of the thermal transfer receiving sheet after the thermal transfer of the protective layer, the section view being shown so as to correspond to input signals shown in FIG. 12(A).

In Example 2, variation ΔH in the thickness of the thermal transfer receiving sheet in the increase direction before and after the thermal transfer of the color material layers was 1.2 μm, and variation ΔL in the thickness of the thermal transfer receiving sheet in the increase direction before and after the thermal transfer of the protective layer was −4.2 μm. In Example 2, the height of the irregularities of the thermal transfer receiving sheet after the thermal transfer of the color material layers and the protective layer was 3.6 μm. Referring to FIG. 9(B), also in Example 2 using the irregularity pattern for the protective layer in which sharpness control was conducted at the boundary between the first thermal energy region E1 and the second thermal energy region E2, the portions of the thermal transfer receiving sheet corresponding to the third thermal energy region E3 were most protruded in the surface of the sheet and irregularities having a large height difference were formed. Thus, according to Example 2, it has been confirmed that an excellent result can be obtained in which a silk texture equivalent to that in silver-salt photographic images is reproduced.

In Comparative example 1, variation ΔH in the thickness of the thermal transfer receiving sheet in the increase direction before and after the thermal transfer of the color material layers was 1.1 μm, and variation ΔL in the thickness of the thermal transfer receiving sheet in the increase direction before and after the thermal transfer of the protective layer was 1.1 μm. In Comparative example 1, the height of the irregularities of the thermal transfer receiving sheet after the thermal transfer of the color material layers and the protective layer was 1.0 μm. Different from Examples 1 and 2, the thermal transfer receiving sheet was carried at higher speed upon the thermal transfer of the protective layer in Comparative example 1 than the carrying speed in Examples 1 and 2. As a result, a sufficiently long period for thermal deformation of the thermal transfer receiving sheet was not provided upon the thermal transfer of the protective layer compared with Examples 1 and 2, and variation in thermal energy applied to the intermediate layer was not provided. Thus, referring to FIG. 10(B), compared with Examples 1 and 2, irregularities having a smaller height difference were formed after the

TABLE 3

| | Thermal transfer receiving sheet | Color material layer transfer condition (msec/line) | Protective layer transfer condition (msec/line) | ΔH (μm) | ΔL (μm) | Height difference of irregularities after printing (μm) | Evaluation results |
|---|---|---|---|---|---|---|---|
| Example 1 | Thermal transfer receiving sheet A | 0.7 | 4.0 | 1.8 | −3.9 | 4.5 | Excellent |
| Example 2 | Thermal transfer receiving sheet A | 0.7 | 4.0 | 1.2 | −4.2 | 3.6 | Excellent |
| Comparative example 1 | Thermal transfer receiving sheet A | 0.7 | 2.0 | 1.1 | 1.1 | 1.0 | Poor |
| Comparative example 2 | Thermal transfer receiving sheet A | 0.7 | 4.0 | 1.5 | −4.4 | 2.5 | Good |
| Comparative example 3 | Thermal transfer receiving sheet B | 0.7 | 4.0 | −2.0 | −4.5 | 1.9 | Fair |

In Example 1, variation ΔH in the thickness of the thermal transfer receiving sheet in the increase direction before and after the thermal transfer of the color material layers was 1.8 μm, and variation ΔL in the thickness of the thermal transfer receiving sheet in the increase direction before and after the thermal transfer of the protective layer was −3.9 μm. In Example 1, the height of the irregularities of the thermal transfer receiving sheet after the thermal transfer of the color material layers and the protective layer was 4.5 μm. Referring to FIG. 8(B), in Example 1, the portions of the thermal transfer receiving sheet corresponding to the third thermal energy region E3 were most protruded in the surface of the sheet and irregularities having a large height difference were formed. Thus, according to Example 1, it has been confirmed that an excellent result can be obtained in which a silk texture equivalent to that in silver-salt photographic images is reproduced.

thermal transfer of the protective layer in Comparative example 1. Therefore, in Comparative example 1, a good result in which a silk texture equivalent to that in silver-salt photographic images was reproduced was not obtained.

In Comparative example 2, variation ΔH in the thickness of the thermal transfer receiving sheet in the increase direction before and after the thermal transfer of the color material layers was 1.5 μm, and variation ΔL in the thickness of the thermal transfer receiving sheet in the increase direction before and after the thermal transfer of the protective layer was −4.4 μm. In Comparative example 2, the height of the irregularities of the thermal transfer receiving sheet after the thermal transfer of the color material layers and the protective layer was 2.5 μm. Different from Examples 1 and 2, referring to FIG. 11(A), the third thermal energy region E3 corresponding to the third thermal energy e3 that was smaller than the minimum thermal energy e0 capable of thermally transferring the protective layer onto the thermal transfer receiving sheet was not provided in Comparative example 2. As a result, compared with Examples 1 and 2, referring to FIG. 11(B), the protruded portions were smaller and irregularities having a smaller height difference were formed after the thermal transfer of the protective layer in Comparative example 2. Therefore, in Comparative example 2, an excellent result of Examples 1 and 2 in which a silk texture equivalent to that in silver-salt photographic images was reproduced was not obtained. However, according to Comparative example 2, it has been confirmed that a good result can be obtained in which a silk texture equivalent to that in silver-salt photographic images is reproduced.

In Comparative example 3, variation ΔH in the thickness of the thermal transfer receiving sheet in the increase direction before and after the thermal transfer of the color material layers was −2.0 μm, and variation ΔL in the thickness of the thermal transfer receiving sheet in the increase direction before and after the thermal transfer of the protective layer was −4.5 μm. In Comparative example 3, the height of the irregularities of the thermal transfer receiving sheet after the thermal transfer of the color material layers and the protective layer was 1.9 μm. Different from Examples 1 and 2, since the thermal transfer receiving sheet did not include a hollow particle layer in Comparative example 3, an unintended collapse occurred in the thickness direction of the thermal transfer receiving sheet upon the thermal transfer of the color material layers. As a result, different from Examples 1 and 2, a large collapse margin was not provided upon the thermal transfer of the protective layer in Comparative example 3. Thus, compared with Examples 1 and 2, referring to FIG. 12(B), irregularities having a smaller height difference were formed after the thermal transfer of the protective layer in Comparative example 3. Therefore, in Comparative example 3, a good result in which a silk texture equivalent to that in silver-salt photographic images was reproduced was not obtained.

In summary, by thermally transferring a color material layer onto the thermal transfer receiving sheet 2 under a printing condition where variation ΔH in the thickness of the thermal transfer receiving sheet 2 in the increase direction before and after the thermal transfer of the color material layer satisfies 0<ΔH, and expanding hollow particles by thermal energy upon the thermal transfer of the color material layer, a larger collapse margin can be provided upon the thermal transfer of the protective layer 7*f* than the collapse margin in an existing thermal transfer receiving sheet that is collapsed in the thickness direction upon the thermal transfer of the color material layer; by thermally transferring the protective layer 7*f* onto the thermal transfer receiving sheet 2 under a printing condition where variation ΔL in the thickness of the thermal transfer receiving sheet 2 in the increase direction before and after the thermal transfer of the protective layer 7*f* satisfies ΔL<0, irregularities having a large height difference can be formed in the thermal transfer receiving sheet 2. As a result, silk-textured images equivalent to those by silver-salt photography can be provided.

Irregularities having a larger height difference can be formed in the thermal transfer receiving sheet 2 with an irregularity pattern for the protective layer 7*f* upon the thermal transfer of the protective layer 7*f*, the irregularity pattern including three different thermal energy regions E1, E2, and E3 respectively formed by different thermal energies e1, e2, and e3 applied upon the thermal transfer of the protective layer 7*f*, the thermal energies e1, e2, and e3 satisfying the relationship represented by the following formula (3) with respect to minimum thermal energy e0 capable of thermally transferring the protective layer 7*f* onto the thermal transfer receiving sheet 2; than in the case where this irregularity pattern is not used, a color material layer is thermally transferred onto the thermal transfer receiving sheet 2 under a printing condition where variation ΔH in the thickness of the thermal transfer receiving sheet 2 in the increase direction before and after the thermal transfer of the color material layer satisfies 0<ΔH and the protective layer 7*f* is thermally transferred onto the thermal transfer receiving sheet 2 under a printing condition where variation ΔL in the thickness of the thermal transfer receiving sheet 2 in the increase direction before and after the thermal transfer of the protective layer 7*f* satisfies ΔL<0. As a result, more preferred silk-textured images equivalent to those by silver-salt photography can be provided.

$$\text{First thermal energy } e1 > \text{Second thermal energy } e2 > e0 > \text{Third thermal energy } e3 \quad (3)$$

Irregularities having a larger height difference can be formed in the thermal transfer receiving sheet 2 with an irregularity pattern in which a third thermal energy region E3 is formed at the boundary between the first thermal energy region E1 and the second thermal energy region E2 than in the case where an irregularity pattern simply includes different thermal energy regions E1, E2, and E3 satisfying the relationship represented by the formula (3) above. As a result, more preferred silk-textured images equivalent to those by silver-salt photography can be provided.

Irregularities can be formed in the thermal transfer receiving sheet 2 upon the thermal transfer of the protective layer 7*f* due to the difference between the degrees of collapse of the surface of the protective layer 7*f* and the collapse of the hollow particles of the intermediate layer 2*b*. As a result, silk-textured images equivalent to those by silver-salt photography can be provided.

It should be understood by those skilled in the art that various modifications, combinations, sub-combinations and alterations may occur depending on design requirements and other factors insofar as they are within the scope of the appended claims or the equivalents thereof.

What is claimed is:

1. An image formation apparatus comprising:

a transporting section configured to transport a thermal transfer sheet on which a color material layer and a protective layer are sequentially arranged in a transporting direction;

a carrying section configured to carry a thermal transfer receiving sheet in which at least a color material receiving layer for receiving a color material is formed on a support;

a thermal head configured to sequentially thermally transfer the color material layer and the protective layer of the thermal transfer sheet onto the thermal transfer receiving sheet by applying thermal energy to the color material layer and the protective layer of the thermal transfer sheet in a state that the color material layer and the protective layer are positioned to face the color material receiving layer of the thermal transfer receiving sheet; and a controlling section configured to control the thermal energy of the thermal head, wherein the controlling section is configured to print an image under printing conditions where variation ΔH represented by the following formula (1) in a thickness of the thermal transfer receiving sheet in an increase direction before and after the thermal transfer of the color material layer satisfies 0<ΔH, and variation ΔL represented by the following formula (2) in the thickness of the thermal transfer receiving sheet in the increase direction before and after the thermal transfer of the protective layer satisfies ΔL<0, $\Delta H$=(thickness of thermal transfer receiving sheet after thermal transfer of color material layer)−(thickness of thermal transfer receiving sheet before thermal transfer of color material layer) (1), and $\Delta L$=(thickness of thermal transfer receiving sheet after thermal transfer of protective layer)−(thickness of thermal transfer receiving sheet before thermal transfer of protective layer) (2).

2. The image formation apparatus according to claim 1, wherein the controlling section is configured to thermally transfer the protective layer onto the thermal transfer receiving sheet in accordance with a predetermined irregularity pattern;

the irregularity pattern upon the thermal transfer of the protective layer includes first, second, and third thermal energy regions respectively formed by different thermal energies e1, e2, and e3 applied upon the thermal transfer of the protective layer; and the thermal energies e1, e2, and e3 respectively applied to the first, second, and third thermal energy regions satisfy a relationship represented by the following formula (3) with respect to minimum thermal energy e0 capable of thermally transferring the protective layer onto the thermal transfer receiving sheet, First thermal energy e1>Second thermal energy e2>e0>Third thermal energy e3 (3).

3. The image formation apparatus according to claim 2, wherein the irregularity pattern upon the thermal transfer of the protective layer includes the third thermal energy region at a boundary between the first thermal energy region and the second thermal energy region.

4. The image formation apparatus according to claim 3, wherein the thermal transfer receiving sheet includes an intermediate layer between the color material receiving layer and the support; and the intermediate layer contains hollow particles.

5. A method for forming an image, comprising the steps of:

transporting a thermal transfer sheet on which a color material layer and a protective layer are sequentially arranged in a transporting direction;

carrying a thermal transfer receiving sheet in which at least a color material receiving layer for receiving a color material is formed on a support;

forming an image by applying thermal energy with a thermal head to the color material layer of the thermal transfer sheet, in a state that the color material layer is positioned to face the color material receiving layer of the thermal transfer receiving sheet, to thermally transfer the color material layer of the thermal transfer sheet onto the color material receiving layer of the thermal transfer receiving sheet; and thermally transferring the protective layer of the thermal transfer sheet onto the image formed on the thermal transfer receiving sheet by applying thermal energy with the thermal head to the protective layer of the thermal transfer sheet in a state that the protective layer is positioned to face the image formed on the thermal transfer receiving sheet;

wherein the image is printed under printing conditions where variation ΔH represented by the following formula (1) in a thickness of the thermal transfer receiving sheet in an increase direction before and after the thermal transfer of the color material layer satisfies 0<ΔH, and variation ΔL represented by the following formula (2) in the thickness of the thermal transfer receiving sheet in the increase direction before and after the thermal transfer of the protective layer satisfies ΔL<0, $\Delta H$=(thickness of thermal transfer receiving sheet after thermal transfer of color material layer)−(thickness of thermal transfer receiving sheet before thermal transfer of color material layer) (1), and $\Delta L$=(thickness of thermal transfer receiving sheet after thermal transfer of protective layer)−(thickness of thermal transfer receiving sheet before thermal transfer of protective layer) (2).

* * * * *